United States Patent [19]

Bakke

[11] Patent Number: 5,062,581

[45] Date of Patent: Nov. 5, 1991

[54] SPOOL SUPPORT APPARATUS

[76] Inventor: William R. Bakke, P.O. Box 9564, Virginia Beach, Va. 23450

[21] Appl. No.: 585,017

[22] Filed: Sep. 18, 1990

[51] Int. Cl.[5] ..... B65H 49/20

[52] U.S. Cl. ..... 242/129.6; 242/134; 242/139; 248/309.1; 248/316.8

[58] Field of Search ..... 242/134, 136, 139, 140, 242/141, 130, 129.5, 129.6, 129.62, 55.2, 55.3; 223/106, 107; 248/309.1, 309.2, 316.8, 317

[56] References Cited

U.S. PATENT DOCUMENTS 70,260 10/1867 Potter ..... 242/129.6

431,347 7/1890 Gore ..... 242/129.6

1,097,421 5/1914 Gault ..... 242/129.62

*Primary Examiner*—Stanley N. Gilreath

*Attorney, Agent, or Firm*—Leon Gilden

[57] ABSTRACT

An apparatus including a plurality of spaced support blocks, with spring biased support arms mounted therebetween. The support arms are arranged for reception of a plurality of spools therealong for support and storage. The support arms are of a spring biased configuration mounted at its rearward end within a rear support block and received within a slot within a forward support block. The slot is directed from a forward wall of the support block downwardly thereof and at an acute angle to secure and receive the forward terminal end of the support arm within the slot.

6 Claims, 5 Drawing Sheets

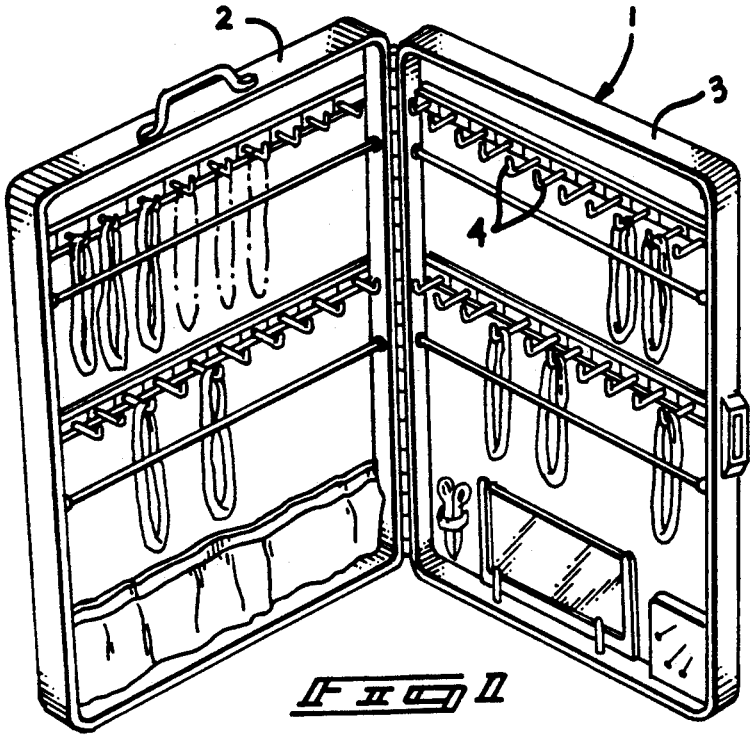
FIG 1
PRIOR ART
FIG 2
PRIOR ART
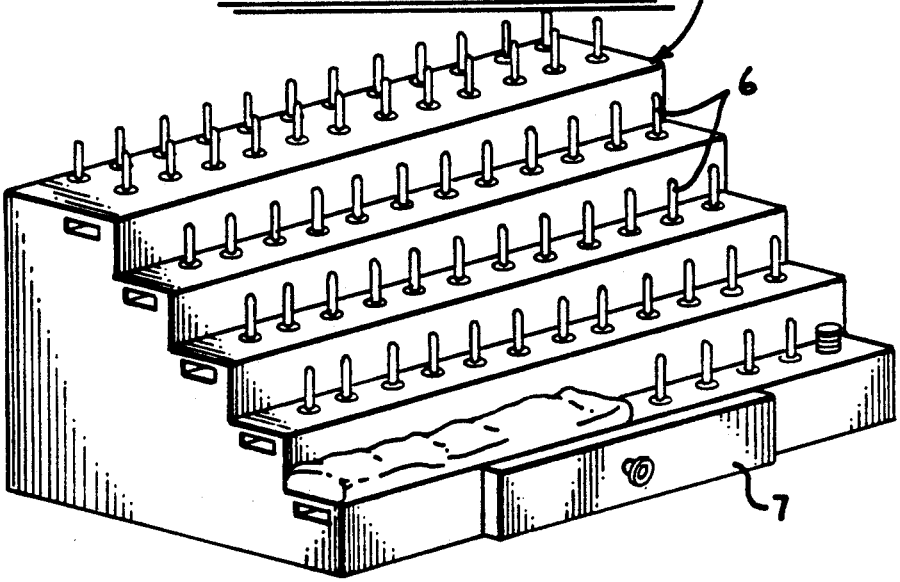

SPOOL SUPPORT APPARATUS

BACKGROUND OF THE INVENTION

1. Field of the Invention

The field of invention relates to spool support apparatus, and more particularly pertains to a new and improved spool support apparatus wherein the same provides selective support and securement of a plurality of spools within the organization.

2. Description of the Prior Art

Spools of various types containing various fabric and non-fabric thread is secured within various storage support organizations. The prior art has in the past provided organizations that have been of relatively cumbersome and elaborate configuration, or else have not provided the enclosed securement required by the instant invention to prevent spools from inadvertent spillage from the associated support structure. Examples of the prior art include U.S. Pat. No. 4,111,341 to Carrozo wherein various fabric is contained within hook portions within a storage container.

U.S. Pat. No. 3,948,396 to Upton, et al. sets forth a device for holding spools, wherein a multi-tiered support utilizes various axles directed upwardly therefrom upon which spools may be placed and subsequently rotated during dispensing procedures.

U.S. Pat. No. 3,506,215 to Kirkorian sets forth an underthread bobbin rack for sewing machines wherein axle portions are mounted within a channel to receive various bobbins for subsequent use within a sewing machine.

U.S. Pat. No. 4,489,865 to Wriedt provides a support structure utilizing a variety of axles for sliding support of spools thereon.

U.S. Pat. No. 4,351,458 to Wolfe sets forth a rotary thread spool support member wherein a vertical post mounts a series of annularly arranged limbs for support of spools thereon for subsequent use.

As such, it may be appreciated that there continues to be a need for a new and improved spool support apparatus wherein the same addresses both the problems of ease of use, as well as effectiveness in construction and in this respect, the present invention substantially fulfills this need.

SUMMARY OF THE INVENTION

In view of the foregoing disadvantages inherent in the known types of support apparatus now present in the prior art, the present invention provides a spool support apparatus wherein the same permits selective storage in a secure and spill-proof manner of a variety of spools. As such the general purpose of the present invention, which will be described subsequently in greater detail, is to provide a new and improved spool support apparatus which has all the advantages of the prior art support apparatus and none of the disadvantages.

To attain this, the present invention provides an apparatus including a plurality of spaced support blocks, with spring support arms mounted therebetween. The support arms are arranged for reception of a plurality of spools therealong for support and storage. The support arms are of a spring biased configuration mounted at its rearward end within a rear support block and received within a slot within a forward support block. The slot is directed from a forward wall of the support block downwardly thereof and at an acute angle to secure and receive the forward terminal end of the support arm within the slot.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved spool support apparatus which has all the advantages of the prior art spool support apparatus and none of the disadvantages.

It is another object of the present invention to provide a new and improved spool support apparatus which may be easily and efficiently manufactured and marketed.

It is a further object of the present invention to provide a new and improved spool support apparatus which is of a durable and reliable construction.

An even further object of the present invention is to provide a new and improved spool support apparatus which is susceptible of a low cost of manufacture with regard to both materials and labor, and which accordingly is then susceptible of low prices of sale to the consuming public, thereby making such spool support apparatus economically available to the buying public.

Still yet another object of the present invention is to provide a new and improved spool support apparatus which provides in the apparatuses and methods of the prior art some of the advantages thereof, while simultaneously overcoming some of the disadvantages normally associated therewith.

Still another object of the present invention is to provide a new and improved spool support apparatus wherein the same utilizes a plurality of spaced blocks underlying a support shelf, wherein the blocks mount spring arms to secure and contain a series of spools in a geometrically secure relationship.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art yarn support apparatus.

FIG. 2 is an isometric illustration of a prior art spool support structure.

DESCRIPTION OF THE PREFERRED EMBODIMENT

Figure 3:
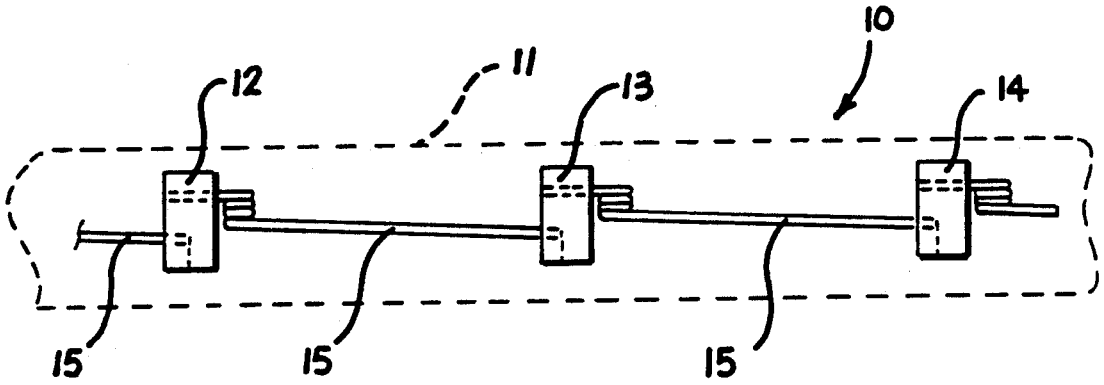
FIG. 3 is an orthographic top view of the instant invention.
Figure 4:
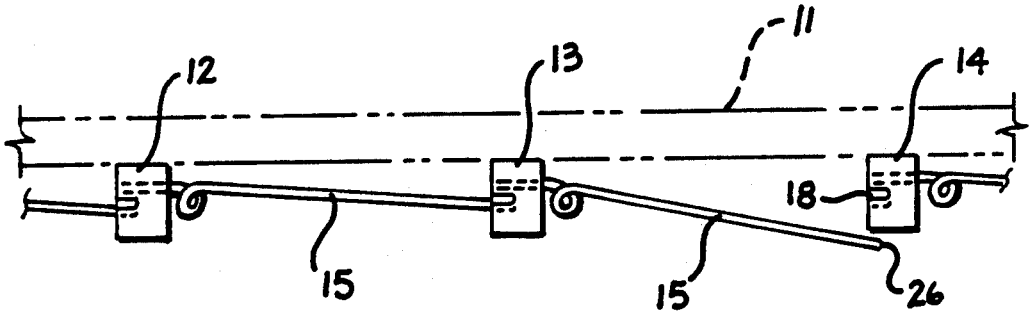
FIG. 4 is an orthographic side view, taken in elevation, of the instant invention.

With reference now to the drawings, and in particular to FIGS. 1 to 9 thereof, a new and improved spool support apparatus embodying the principles and concepts of the present invention and generally designated by the reference numerals 10 and 10*a* will be described.

FIG. 1 illustrates a prior art yarn support housing 1, including a first portion 2 securable selectively to a second portion 3 utilizing a matrix of hook members 4 within each of the portions to permit storage of yarn members therewithin. FIG. 2 illustrates a prior art spool support apparatus 5 defined by a multi-tiered structure mounting a single or plural row of axles 6 orthogonally upwardly from each of the tiers for support of spools thereon, with a shelf member 7 provided at a lowermost portion of the organization.

Figure 5:
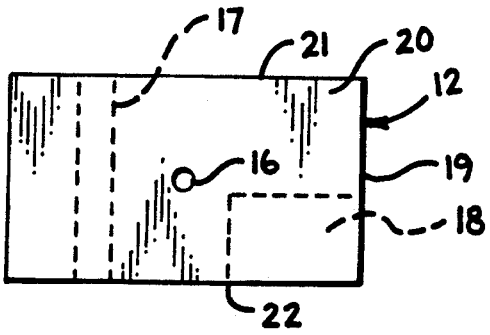
FIG. 5 is an orthographic top view of a support block utilized by the instant invention.
Figure 6:
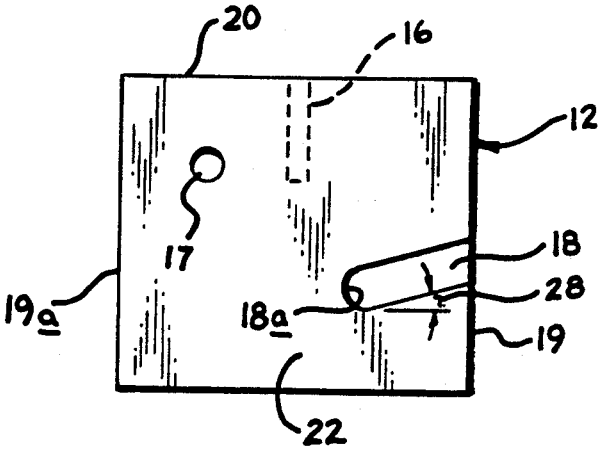
FIG. 6 is an orthographic side view, taken in elevation, of the support block as illustrated in FIG. 5.
Figure 7:
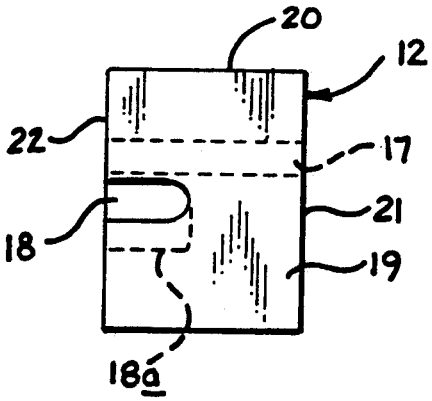
FIG. 7 is an orthographic front view, taken in elevation, of the support block as illustrated in FIGS. 5 and 6.
Figure 8:
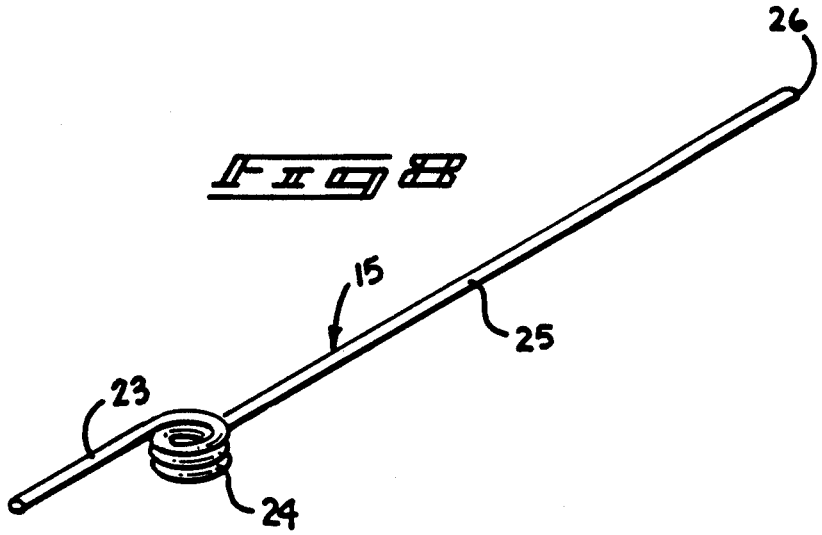
FIG. 8 is an isometric illustration of the spring bias support arm of the instant invention.

More specifically, the spool support apparatus 10 of the instant invention essentially comprises a support plate 11 defining a shelf that includes a series of support blocks defined by a first, second, and third support block 12, 13, and 14 spaced at equal predetermined intervals relative to one another. It is understood that a further series of support blocks may be provided to permit mounting of a series of spring biased support arms 15 between adjacent support blocks, as illustrated. Each spring biased support arm 15 is fixedly mounted at its rearward portion within a rear support block and is selectively securable and received within a forward support block, wherein for purposes of illustration, the first support block 12 fixedly secures an arm anchor shank 23 (see FIG. 8) within a through-extending support bore 17 defined by an internal configuration complementary to that of an external configuration defined by the arm anchor shank 23. The second support block 13 receives a forward terminal end 26 (see FIG. 8) of an arm support shank 25 of the support arm 15, wherein a spring coil 24 biases the arm support shank 25 rearwardly and downwardly of a forward wall 19 of each support block. FIGS. 5–7 set forth the organization of the first support block, but it is understood that each support block is of an identical configuration, wherein for purposes of illustration the first support block 12 will be discussed.

Figure 9:
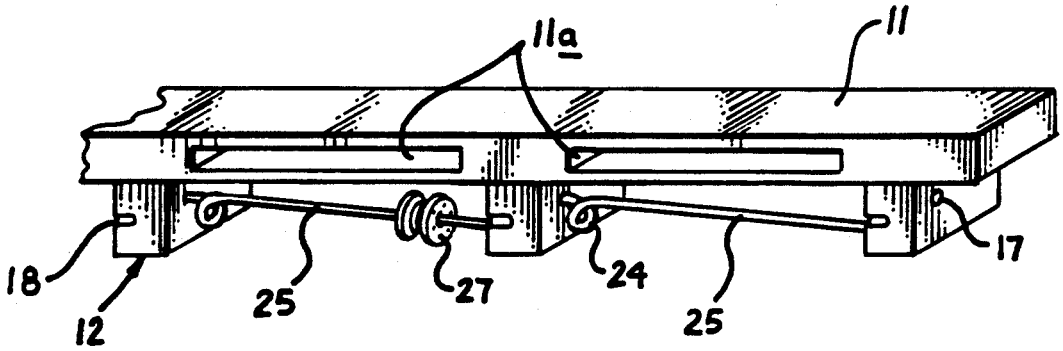
FIG. 9 is an isometric illustration of the instant invention.

The first support block 12 includes a forward wall 19 spaced from and parallel a rear wall 19*a*. A top wall 20 is spaced from and parallel a bottom wall, with a forward side wall 21 spaced from and parallel a rear side wall 22. The top wall 20 includes a blind mounting bore 16 directed orthogonally through the top wall 20 a predetermined spacing to receive a fastener (not shown) to secure each support block to the associated support plate 11. The through-extending support bore 17 is directed orthogonally through the forward side wall 21 and the rear side wall 22. The through-extending support bore 17 is positioned adjacent the rear wall 19*a*, as illustrated. A slot 18 receives the forward terminal end 26 of the arm support shank 25, and wherein the slot 18 is directed and defines an opening through the forward wall 19 and is directed downwardly through the block defining a bottom floor 18*a* to position the forward terminal end 26 thereagainst when the forward terminal end 26 is received within the slot 18. The slot 18 defines an acute angle 28 between the slot 18 and the bottom wall of the block 12. The slot 18 defines an opening to the forward wall 19, as set forth above, and further extends the opening from the forward wall 19 through the rear side wall 22 to permit reception of the forward terminal end 26 within the slot 18. The slot 18 is directed orthogonally into the support block 12 from the rear side wal 22 a predetermined length less than a predetermined width of the block defined between the side walls. Accordingly, as illustrated in FIG. 9 for example, the support arm 15 extends from a first support block 12 to a forwardly positioned support block, such as a second support block 13, and wherein the support arm 15 defines a support arm length from a forward side wall of a rear or first support block 12 to a rear side wall of a forwardly positioned or second support block 13. In this manner, a single or plurality of spools 27 are positionable upon the arm support shank 25 for storage and use as required.

Figure 10:
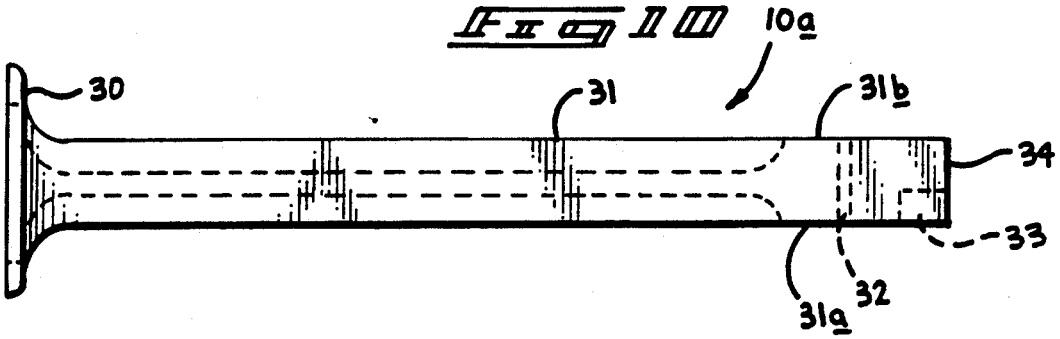
FIG. 10 is an orthographic top view of a free standing arm utilized by the instant invention.
Figure 11:
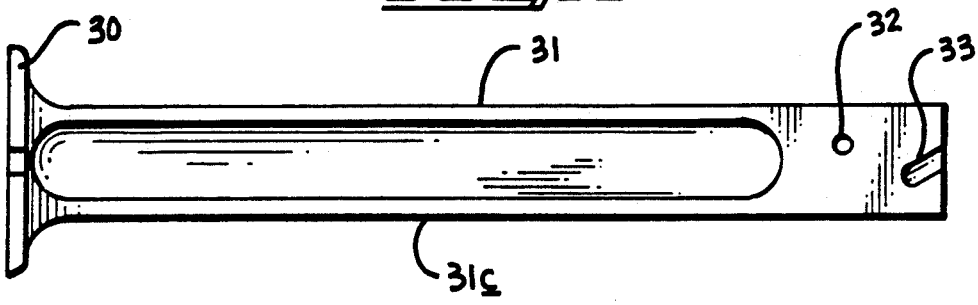
FIG. 11 is an orthographic side view, taken in elevation, of the free standing arm as set forth in FIG. 10.
Figure 12:
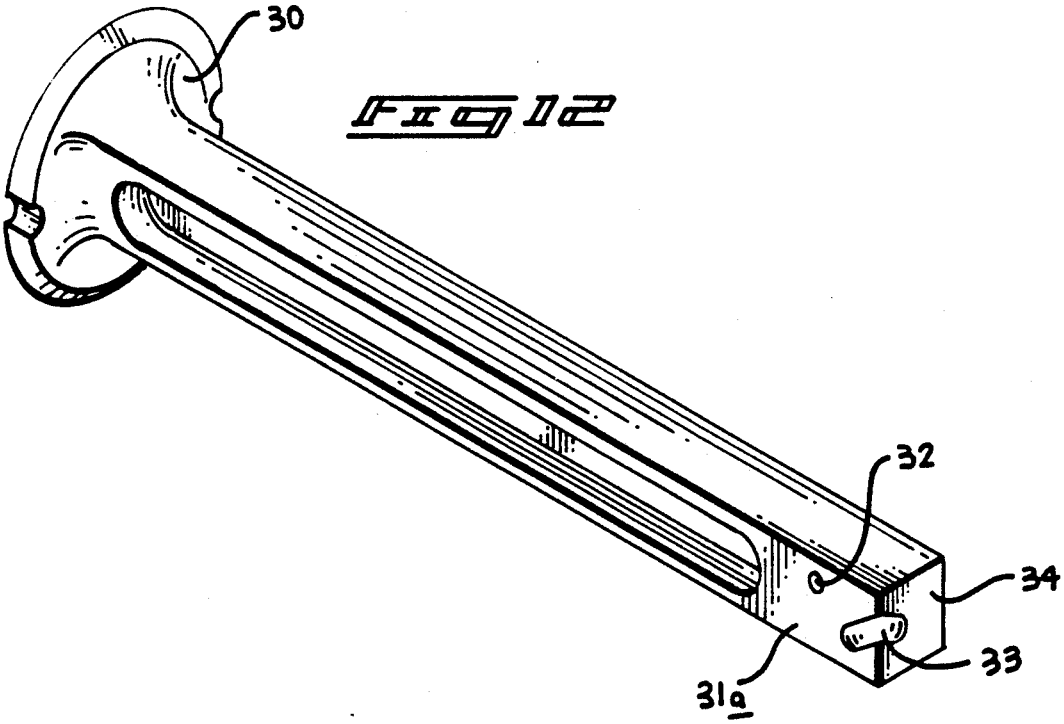
FIG. 12 is an isometric illustration of the free standing arm as illustrated in FIGS. 10 and 11.

FIGS. 10–12 illustrate the modified structure 10*a*, wherein a plurality of the arms 10*a* are utilized in lieu of support blocks 12, wherein the arms are spaced apart the predetermined spacing. The arms each include a mounting web 30, with an elongate leg 31. The elongate leg 31 includes a leg left side wall 31*a* and a leg right side wall 31*b*. An elongate bore 32 is orthogonally directed through the elongate leg and the right and left side walls parallel to and adjacent the forward end wall 34 of the elongate leg 31. The elongate leg 31 is orthogonally oriented relative to the mounting web 30. A groove 33 is angulated downwardly from the forward end wall 34 and defined at an acute angle between the forward end wall 34 and a bottom side wall 31*c* of the leg 31*a*. These legs 31 are arranged to be mounted at a spaced apart relationship, in a manner as set forth by the blocks 12 per the illustration of FIG. 4 for example, utilizing each a support arm 15, with a rear end of the support arm 15 mounted within a rearwardly oriented elongate bore 32 and the forward end of the support arm positioned within the groove 33 to support various spools, ribbons, bags, and the like.

Further, if necessary, labels 11*a* are provided overlying each support arm 15 between spaced support blocks for indication of various categories of spools 27 to be stored and secured within each respective support arm 15.

As to the manner of usage and operation of the present invention, the same should be apparent from the above disclosure, and accordingly, no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

What is claimed as being new and desired to be protected by LETTERS PATENT of the United States is as follows:

1. A spool support apparatus comprising, an elongate support plate defined by a top surface and underlying bottom surface, and a plurality of support blocks fixedly mounted to the bottom surface of the support plate, including at least a first support block and a second support block, and at least one spring biased support arm including a rear terminal end and a forward terminal end, the rear terminal end mounted within the first support block, and the forward terminal end selectively receivable within the second support block, and the first support block includes a forward wall spaced from and parallel a rear wall, and a top wall spaced from and parallel a bottom wall, and a forward side wall spaced from and parallel a rear side wall, and the rear terminal end of the spring biased support arm including an arm support shank, the arm support shank received within a through-extending support bore, the support bore orthogonally directed through the rear side wall and the forward side wall of the first support block adjacent the rear wall of the support block.

2. An apparatus as set forth in claim 1 wherein the second support block includes a slot directed from the forward wall downwardly and rearwardly of the support block to receive the forward terminal end of the support arm.

3. An apparatus as set forth in claim 2 wherein the slot defines an acute angle between the slot and the bottom wall of the support block.

4. An apparatus as set forth in claim 3 wherein the slot extends downwardly to define a slot floor, the slot floor spaced above the bottom wall of the support block, and the slot defining a slot opening through the forward wall of the block and defining a side wall opening through the rear side wall of the block to receive the forward terminal end of the support arm therethrough, and the slot extending orthogonally from the rear side wall interiorly of the block and extends a slot length less than a predetermined width defined between the forward side wall and rear side wall of the second support block.

5. An apparatus as set forth in claim 4 wherein the support arm includes a spring coil wound within the support arm between the forward terminal end and the rear terminal end, and the spring coil defining an arm support shank between the spring coil and the forward terminal end of the support arm, and the support arm extending a support arm length greater than a predetermined spacing defined between the first support block and the second support block.

6. An apparatus as set forth in claim 5 wherein each support block includes a blind bore extending orthogonally and interiorly of the support block from the top wall of the support block to receive a fastener to secure each support block to the bottom surface of the support plate.

* * * * *